US006328060B1

(12) United States Patent
Smith

(10) Patent No.: US 6,328,060 B1
(45) Date of Patent: Dec. 11, 2001

(54) GASOLINE DISPENSING UNIT AND METHOD WITH IMPROVED HOSE HANDLING

(75) Inventor: Richard Michael Smith, Salisbury, MD (US)

(73) Assignee: Dresser, Inc., Addison, TX (US)

( * ) Notice: Subject to any disclaimer, the term of this patent is extended or adjusted under 35 U.S.C. 154(b) by 0 days.

(21) Appl. No.: 09/491,935

(22) Filed: Jan. 26, 2000

(51) Int. Cl.[7] ..... E01H 1/10

(52) U.S. Cl. ..... 137/355.02; 137/355.23; 242/376

(58) Field of Search ..... 137/355.2, 355.23; 242/376

(56) References Cited

U.S. PATENT DOCUMENTS

| | | | | |
|---|---|---|---|---|
| 745,633 | * | 12/1903 | White et al. | 242/376 |
| 1,485,663 | * | 3/1924 | Best | 242/376 |
| 1,794,825 | * | 3/1931 | Benedict | 242/376 |
| 1,926,452 | * | 9/1933 | Norling | 242/376 |
| 1,933,925 | * | 11/1933 | Norling | 242/376 |
| 2,545,063 | * | 3/1951 | Wolfe | 137/355.2 |
| 2,564,623 | * | 8/1951 | Harks | 137/355.2 |
| 2,694,601 | * | 11/1954 | Higginbotham | 137/355.2 |
| 2,939,680 | * | 6/1960 | Powell | 242/376 |
| 3,160,333 | * | 12/1964 | Budrow | 137/355.2 |
| 3,612,094 | * | 10/1971 | Hare | 137/355.2 |
| 5,018,549 | * | 5/1991 | Lucas | 137/355.23 |
| 5,054,162 | * | 10/1991 | Rogers | 16/198 |
| 5,074,483 | * | 12/1991 | Wang | 242/376 |
| 5,139,751 | * | 8/1992 | Mansfield et al. | 422/292 |
| 5,794,648 | * | 8/1998 | Jentzsch et al. | 137/355.23 |

* cited by examiner

*Primary Examiner*—A. Michael Chambers
*Assistant Examiner*—Thomas L. McShane
(74) *Attorney, Agent, or Firm*—Jenkens & Gilchrist P.C.

(57) ABSTRACT

A gasoline dispensing unit and method according to which one end of a cord is attached to a dispensing hose to support the hose relative to a dispenser unit during non-use. The other end of the cord is attached to a drum having a tapered outer surface and a continuous spiral groove. When the hose is not in use, the cord is wound on the drum from the largest-diameter drum portion to the smallest-diameter portion. The cord thus unwinds from the drum from its smallest-diameter portion to the largest-diameter portion when the hose is pulled from the housing to provide a mechanical advantage and reduce the required pulling force.

5 Claims, 3 Drawing Sheets

GASOLINE DISPENSING UNIT AND METHOD WITH IMPROVED HOSE HANDLING

BACKGROUND

This invention relates to a gasoline dispensing unit and method and, more particularly, to such a unit and method according to which it is relatively easy to move the dispensing hose to and from the housing of the dispensing unit.

In gasoline services station installations, the gasoline is pumped from underground storage tanks, and through conduits, or tubes, to the hydraulics section of a dispenser unit. Conduits are provided in the hydraulics section and are connected to the conduits extending from the storage tank. The conduits in the hydraulics section extend through the dispensing unit and are connected to one or more hoses that extend from the dispenser unit for dispensing the gasoline into a vehicle tank through nozzles attached to the hoses. A system valve is provided to control the gasoline flow, and a meter is connected in the system for metering the flow so that the volume of gasoline dispensed can be displayed on the dispenser unit and the customer charged accordingly.

If the system is adapted for vapor recovery, an additional hose is provided which receives vapor in the vehicle tank during the dispensing operation and passes the vapor to an additional conduit in the dispenser unit. The latter conduit is, in turn, connected to a conduit at the hydraulics section that extends back to the storage tank for returning the vapors to the tank.

The above-mentioned hoses are usually retracted, or gathered, relative to the housing of the dispenser unit during non-use and must be pulled out from the unit by the customer prior to use. However, as can be appreciated, these hoses are relatively heavy and it takes a great deal of effort and strength for the customer to handle them properly. To compound this problem, the amount of force required to pull the nozzle and the hose out from the housing increases as the nozzle and hose are pulled out due to the provision of a spring, or the like, which is put under tension in the pulling-out process and which functions to aid in retracting the hose when the dispensing is completed. Thus, as a portion of the hose is pulled out from the housing, the force required to pull the remaining portion increases.

Therefore, what is needed is a dispensing unit and method according to which the force required to pull the hose out from the dispensing unit does not increase as the hose is being pulled out thus reducing the effort required by the customer.

SUMMARY

Accordingly, a gasoline dispensing unit and method is provided according to which one end of a cord is attached to a dispensing hose to support the hose relative to a dispenser unit during non-use. The other end of the cord is attached to a drum having a tapered outer surface and a continuous spiral groove, and, when the hose is not in use, the cord is wound on the drum from the largest-diameter drum portion to the smallest-diameter portion. The cord thus unwinds from the drum from its smallest-diameter portion to the largest-diameter portion when the hose is pulled from the housing to provide a mechanical advantage and reduce the required pulling force.

Thus, in accordance with the system and method of the above embodiment, the force required to pull the dispensing nozzle and the hose out from the dispensing unit does not increase as the hose is being pulled out. As a result the effort required by the customer to pull the hose completely out of the dispensing unit is decreased.

DETAILED DESCRIPTION

Figure 1:
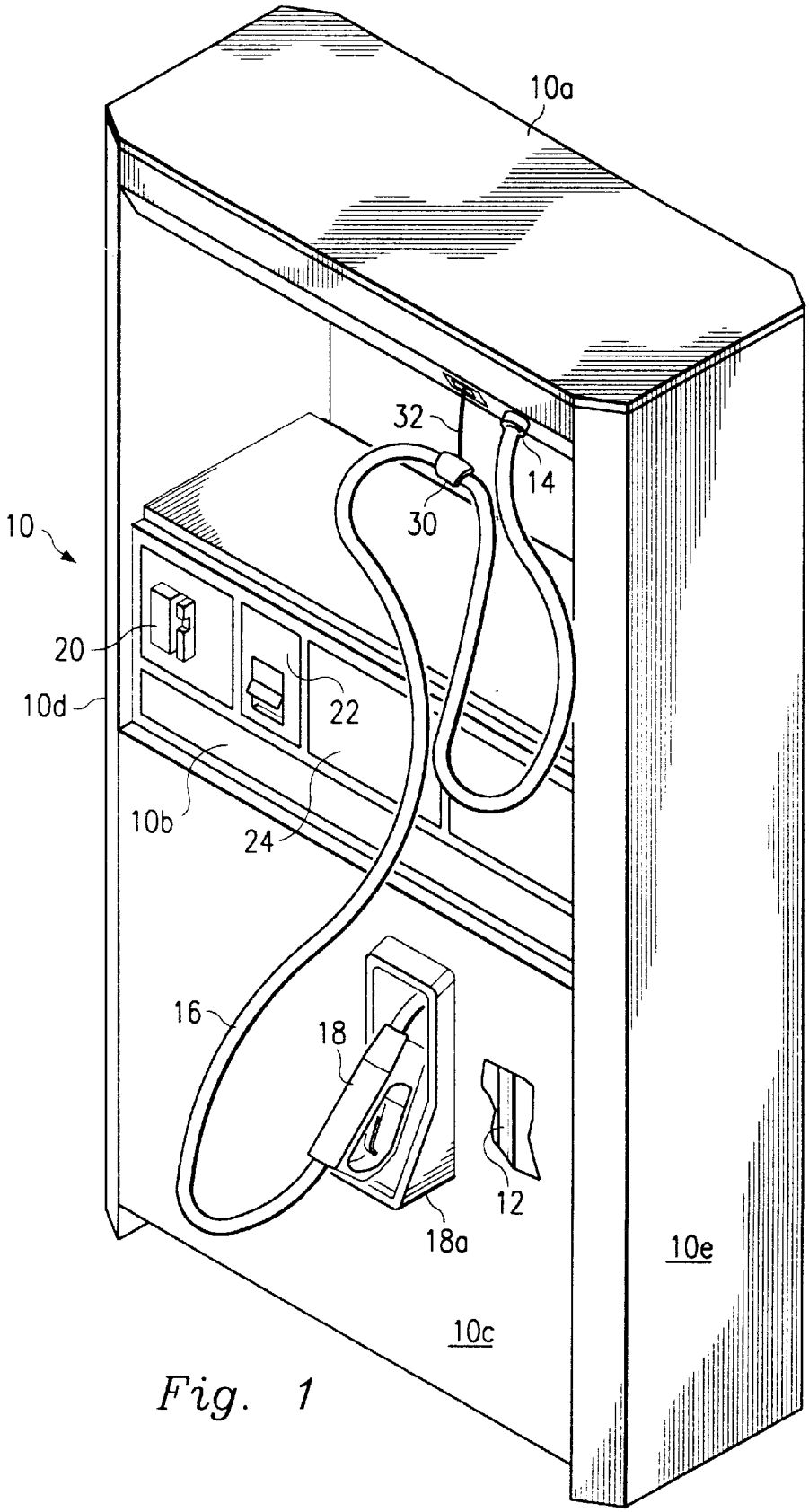
FIG. 1 is an isometric view of a gasoline dispensing unit according to an embodiment of the present invention.

With reference to FIG. 1, the reference numeral 10 refers, in general, to a dispenser unit having an upper section 10*a*, an electronics section 10*b* extending below, and in a spaced relation to, the upper section, and a hydraulics section 10*c* extending immediately below the electronics section. The sections 10*a*, 10*b* and 10*c* are in the form of self-contained housings supported between, and connected to, two spaced upright support members 10*d* and 10*e*.

A conduit 12 extends from an underground storage tank (not shown) into the interior of the hydraulics housing 10*b*, where it is connected to a fitting 14 extending through the upper housing section 14*a*. One end of a hose 16 extends from the fitting 14, and a nozzle 18 is connected to the other end of the hose 16. Thus, gasoline passing from the storage tank, and through the conduit 12 and the hose 16 can be dispensed, via the nozzle 18 to a vehicle tank. To this end, a pump (not shown) is connected to the conduit 12 for pumping the gasoline, and it is understood that the electronics section 10*b* includes a meter for metering the flow of the gasoline in a conventional manner. A boot 18*a* is provided on the hydraulics sections 10*c* for housing the nozzle 18 during nonuse.

The electronics section 10*b* contains various electronic components, including a credit card reader 20, a receipt dispenser 22, and a display 24 which displays the volume of gasoline dispensed and the cost of same. The respective fronts of the reader 20, the receipt dispenser 22, and the display 24 extend through the front panel, or bezel, of the section 10*b*.

Although not shown in the drawing, it is understood that additional storage tanks can be provided for different grades of gasoline, in which case additional conduits, similar to conduit 12 would be provided for passing the gasoline to the hose 16 under the control of a valve, or switcher, or to additional hoses similar to the hose 16. Also, it is understood that a hose and a nozzle identical to the hose 16 and the nozzle 18, are provided on the opposite side of the dispenser unit 10, and that the electronics section 10*b* and the hydraulic section 10*c* also extend to this opposite side. In this manner, customers can be serviced on both sides of the dispenser unit 10. Since all of this is conventional, it will not be described in further detail.

If the system is adapted for vapor recovery, an additional hose (not shown) similar to the hose 16 would be provided which receives vapor from the vehicle tank, via the nozzle 18, during the dispensing operation and passes the vapor to the conduit 12. A pump would be provided to pump the vapor from the vehicle tank, through the nozzle 18, the above hose and conduit to the storage tank.

Figure 2:
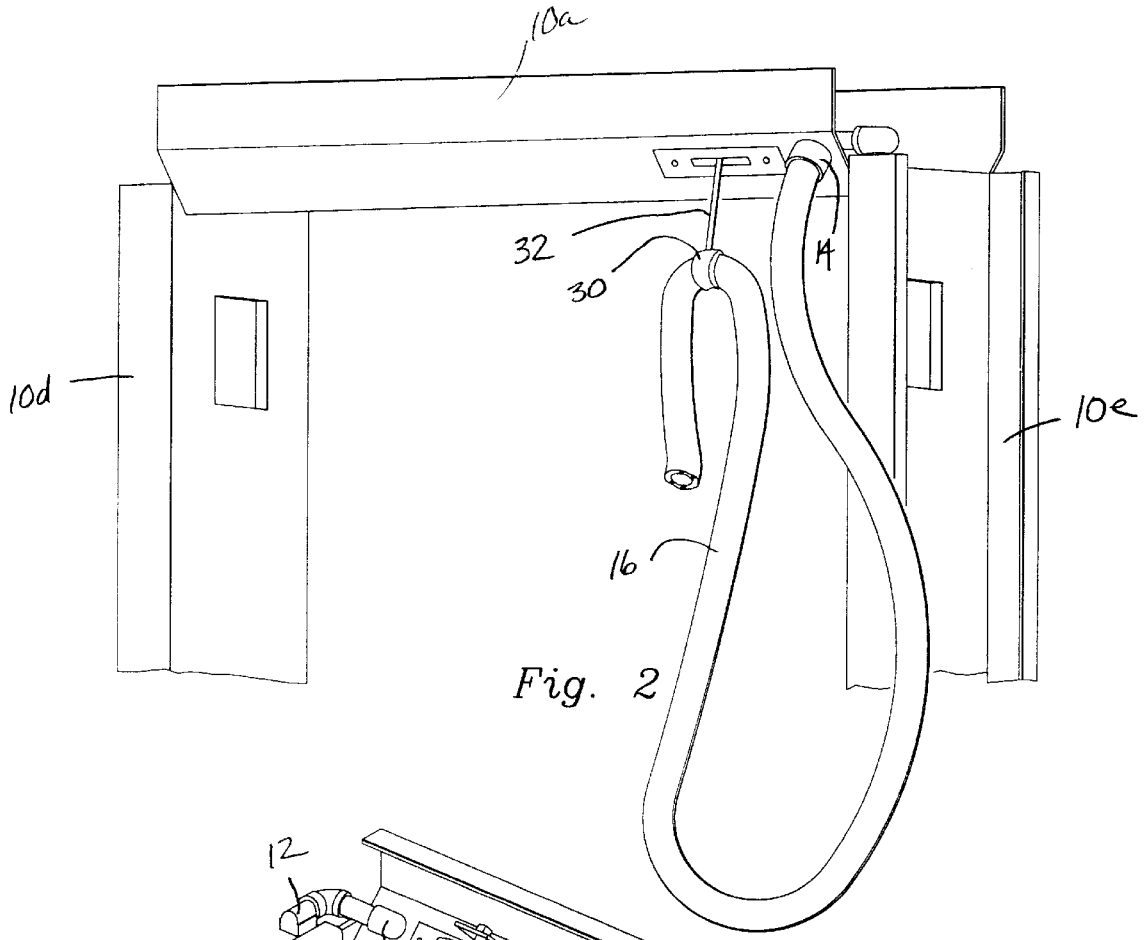
FIG. 2 is an enlarged, partial isometric view of a front portion of the unit of FIG. 1.
Figure 3:
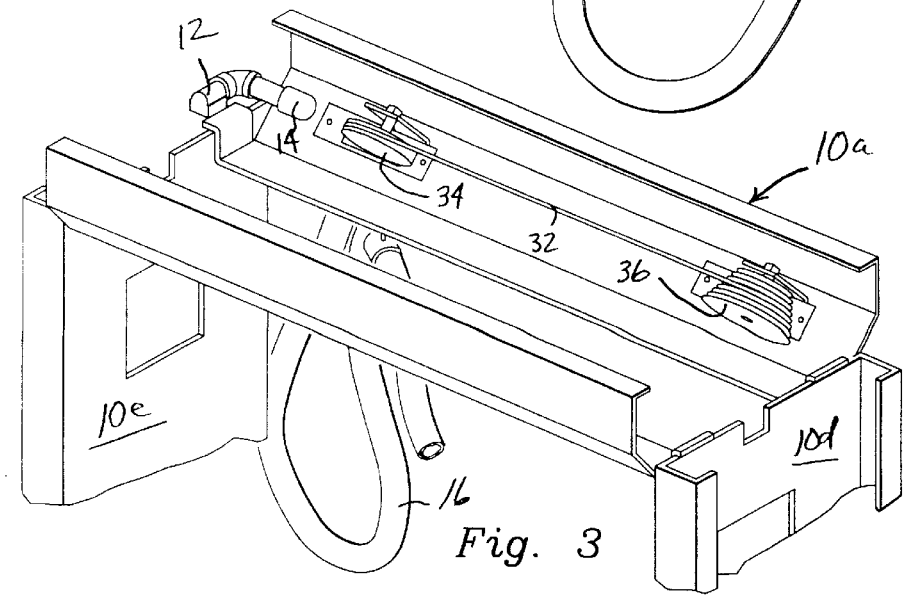
FIG. 3 is an enlarged, partial isometric view of a rear portion of the unit of FIG. 1.

The end portion of the hose 16 that is connected to the fixture 14 is doubled over two times to gather the entire length of the hose between the fixture 14 and the boot 18*a*. To this end, a ring-shaped hanging bracket 30 extends around a segment of the doubled-over portion of the hose 16 slightly below the lower portion of the upper housing 10*a*. As better shown in FIG. 2, one end of a rope, or cord, 32 is connected to the bracket 30 and extends through a slot in the upper housing 10*a*. As shown in FIG. 3, a pulley 34 and a drum 36 are both rotatably mounted inside the upper housing 10*a* in a spaced relation, and the cord 32 extends over the pulley and to the drum with its other end connected to the drum. In the inactive position of the nozzle 18 and the hose 16 shown in FIGS. 1–3, a portion of the cord is wound on the drum 36.

When the nozzle 18, and therefore the corresponding end of the hose 16, are pulled out from the unit 10 to a gasoline-dispensing position relative to a vehicle, the bracket 30 is also pulled out, or away from the upper housing 10*a*. This pulls the cord 32 out, causing the portion of the cord on the drum to unwind from the drum and pass over the pulley 34. The length of the cord 32 is such that when the hose 16 is pulled out from the dispensing unit 10 so that its full length can be utilized during the dispensing operation, the cord is substantially unwound from the drum.

Figure 4:
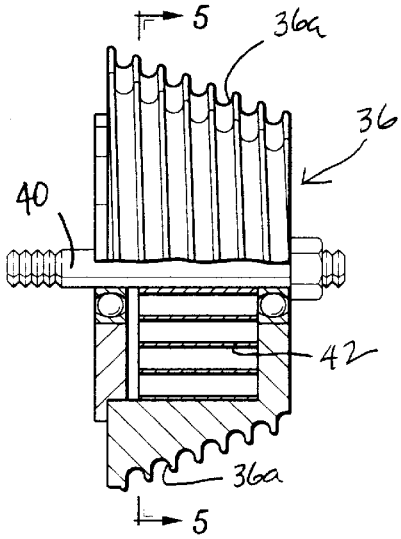
FIG. 4 is an enlarged side elevational view of a drum used in the unit of FIGS. 1–3.
Figure 5:
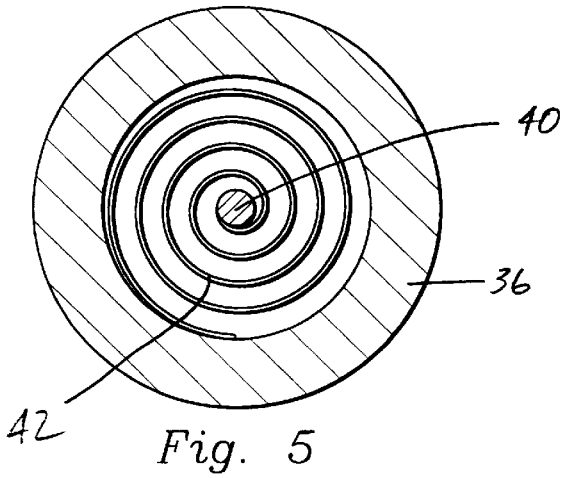
FIG. 5 is an enlarged cross-sectional view taken along the line 5—5 of FIG. 4.

As shown in FIGS. 4 and 5 the outer surface of the drum 36 is tapered and is provided with a continuous helical, or spiral, groove 36*a* for receiving the cord 32 when the cord is wound on the drum during the inactive position of the nozzle 18 and the hose 16. The drum 36 is rotatably mounted around a fixed shaft 40 that is mounted inside the upper housing 10*a* in any conventional manner. The inside diameter of the drum 36 is greater than the outer diameter of the shaft 40, and a coiled spring 42 is disposed in the space between the shaft and the drum. One end of the spring 42 attached to the shaft 40 and the other end is attached to the inner surface of the drum 36 in any conventional manner.

When a customer pulls the nozzle 18, and therefore the corresponding end of the hose 16, from the dispensing unit 10 preparatory to dispensing gasoline, the cord 32 is unwound from the drum 36 causing the drum to rotate in a counter-clockwise direction as viewed in FIG. 3. This rotation causes the spring 42 to tighten around the shaft 40 to place it in tension and thus load the spring. After the dispensing is completed, and the customer relaxes the tension on the hose 14, the tension on the spring will also be released causing the spring to rotate the drum 36 in a clockwise direction which rewinds the cord 32 on the drum, pulls the bracket 32 and the corresponding portion of the hose 16 towards the dispenser unit 10, and thus assists the customer in returning the nozzle and the hose to the inactive position shown in FIGS. 1–3.

According to a feature of the invention, during the winding of the cord 32 on the drum 36 as described above, the end portion of the cord is initially wound on that portion of the drum having the largest diameter, as best viewed in FIG. 4. As the winding continues, the cord 32 progressively winds on the drum from its larger diameter portions to its smaller-diameter portions until the cord winds to the smallest diameter portion of the drum. In this position, the nozzle 18 and the hose 16 reach their inactive positions shown in FIGS. 1–3.

Therefore, when a customer pulls the nozzle 18, and therefore the corresponding end of the cord 32 as described above, the cord 32 initially unwinds from the smallest-diameter portion of the drum 36 and then progressively unwinds towards the largest-diameter portion. This increase in the diameter of the drum 36 from which the cord is unwound produces a mechanical advantage which overcomes the added force required to tighten the spring 42 around the shaft 40. As a result the force required to pull the nozzle 18, and the corresponding end of the hose 16, out to a gasoline dispensing position is considerably reduced when compared to an arrangement in which the outer diameter of the drum is not tapered.

Of course, after the dispensing is completed and the customer relaxes tension on the hose 16 preparatory to returning the nozzle to the boot 18*a*, the tension on the spring 42 will be released, causing it to unwind and rotate the drum 36 in an clockwise direction as viewed in FIG. 3, to wind the cord 32 back on the drum.

Thus, if the drum 36 had a constant diameter outer surface, the force required to pull the nozzle 18 and the corresponding end of the hose 16 out from the dispensing unit would increase as they are being pulled out due to the tensioning of the spring 42. However according to the above embodiment, this pulling force does not increase due to the mechanical advantage gained by the cord 32 progressively unwinding towards the increased-diameter portion of the drum 36, and may even decrease.

It is understood that variations may be made in the foregoing without departing from the scope of the invention. For example, the references to "conduit", "hose", "tube" "pipe", and the like are not meant to be limited to any particular fluid flow device and any such device or devices can be used throughout the system. Further, spatial references, such as "upper", "lower", "side", "front", and "rear" are for the purpose of illustration only and do not limit the specific orientation or location of the structure described above. Further, the system and method of the present invention is not limited to a gasoline dispensing system but is equally applicable to any fluid flow utilizing hoses in the manner described above.

Since other modifications, changes, and substitutions are intended in the foregoing disclosure, it is appropriate that the appended claims be construed broadly and in a manner consistent with the scope of the invention.

What is claimed is:

1. A gasoline dispensing unit comprising a housing, a drum rotatably mounted to the housing and having a variable diameter and a continuous spiral groove formed on its outer surface; a spring engaging the drum; a pulley rotatably mounted to the housing and extending in a spaced relation to the drum; a cord attached at one end to the drum, a hose attached to the other end of the cord for supporting the hose relative to the housing, a portion of the cord extending over the pulley and another portion of the cord being wound on the drum from the largest-diameter drum portion to the smallest-diameter portion so that, when the hose is pulled from the housing, the drum rotates so that the other portion of the cord unwinds from the drum and passes over the pulley; the rotation of the cord from the drum tensioning the spring so that, upon release of the pulling force, the spring rotates the drum to rewind the other portion of the cord back on the drum.

2. The dispensing unit of claim 1 further comprising a bracket connected between the cord and the hose.

3. The dispensing unit of claim 1 wherein one end of the hose is attached to the cord and further comprising a dispensing nozzle attached to the other end of the hose.

4. A gasoline dispensing method comprising the steps of attaching one end of a cord to a dispensing hose to support the hose relative to a dispenser unit, passing the cord over a pulley, attaching the other end of the cord to a drum having a tapered outer surface and a continuous spiral groove, extending a first portion of the cord over the pulley and winding another portion of the cord over the drum from the largest-diameter drum portion to the smallest-diameter portion, so that when the hose is pulled from the housing, the other cord portion is unwound from the drum from the smallest-diameter portion to the largest-diameter portion to provide a mechanical advantage and reduce the required pulling force; and connecting a spring to the drum so that the unwinding of the cord from the drum tensions the spring and a release of the pulling force permits the spring to rotate the drum and wind the other cord portion back on the drum.

5. The method of claim 4 wherein the cord is attached to one end of the hose and further comprising attaching a dispensing nozzle to the other end of the hose.

* * * * *

UNITED STATES PATENT AND TRADEMARK OFFICE

CERTIFICATE OF CORRECTION

PATENT NO. : 6,328,060 B1
DATED : December 11, 2001
INVENTOR(S) : Richard Smith

It is certified that error appears in the above-identified patent and that said Letters Patent is hereby corrected as shown below:

Column 2,
Lines 27-40, please delete the second paragraph in the "Detailed Description" and insert the following paragraph therefor:

-- A conduit 12 extends from an underground storage tank (not shown) into the interior of the hydraulics housing 10b, where it is connected to a fitting 14 extending through the upper housing section 10a. One end of a hose 16 extends from the fitting 14, and a nozzle 18 is connected to the other end of the hose 16. Thus, gasloline passing from the storage tank, and through the conduit 12 and the hose 16 can be dispensed, via the nozzle 18 to a vehicle tank. To this end, a pump (not shown) is connected to the conduit 12 for pumping the gasoline, and it is understood that the electronics section 10b includes a meter for metering the flow of the gasoline in a conventional manner. A boot 18a is provided on the hydraulics sections 10c for housing the nozzle 18 during non-use. --

Column 3,
Lines 1-15, please delete the first paragraph and insert the following paragraph therefor:

-- The end portion of the hose 16 that is connect to the fitting 14 is doubled over two times to gather the entire length of the hose between the fitting 14 and the boot 18a. To this end, a ring-shaped hanging bracket 30 extends around a segment of the doubled-over portion of the 16 slightly below the lower portion of the upper housing 10a. As better shown in Fig. 2, one end of a rope, or cord, 32 is connected to the bracket 30 and extends through a slot in the upper housing 10a. As shown in Fig. 3, a pulley 34 and a drum 36 are both rotatably mounted inside the upper housing 10a in a spaced relation, and the cord 32 extends over the pulley and to the drum with its other end connected to the drum. In the inactive position of the nozzle 18 and the hose 16 shown in Figs 1-3, a portion of the cord is wound on the drum 36. --

UNITED STATES PATENT AND TRADEMARK OFFICE

CERTIFICATE OF CORRECTION

PATENT NO. : 6,328,060 B1
DATED : December 11, 2001
INVENTOR(S) : Richard Smith

It is certified that error appears in the above-identified patent and that said Letters Patent is hereby corrected as shown below:

Column 3,
Lines 26-37, please delete the last paragraph and insert the following paragraph therefor:

-- As shown in Figs. 4 and 5 the outer surface on the drum 36 is tapered and is provided with a continuous helical, or spiral, groove 36a for receiving the cord 32 when the cord is wound on the drum during the inactive position of the nozzle 18 and the hose 16 (Fig. 3). The drum 36 is rotatably mounted around a fixed shaft 40 that is mounted inside the upper housing 10a in any conventional manner. The inside diameter of the drum 36 is greater than the outer diameter of the shaft 40, and a coiled spring 42 id disposed in the space between the shaft and the drum. One end of the spring 42 is attached to the shaft 40 and the other end is attached to the inner surface of the drum 36 in any conventional manner. --

Signed and Sealed this

Thirtieth Day of July, 2002

*Attest:*

*Attesting Officer*

JAMES E. ROGAN
*Director of the United States Patent and Trademark Office*